US006969243B1

(12) United States Patent
Lifson et al.

(10) Patent No.: US 6,969,243 B1
(45) Date of Patent: Nov. 29, 2005

(54) SCROLL COMPRESSOR WITH RECESS ON CRANKCASE OR ORBITING SCROLL

(75) Inventors: Alexander Lifson, Manlius, NY (US); Thomas R. Barito, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/869,296

(22) Filed: Jun. 16, 2004

(51) Int. Cl.[7] ..... F04C 18/00
(52) U.S. Cl. ..... 418/55.5; 418/57; 418/55.2; 418/55.1
(58) Field of Search ..... 418/55.5, 57, 55.2, 418/55.1

(56) References Cited

U.S. PATENT DOCUMENTS 5,085,565 A * 2/1992 Barito ..... 418/55.5
5,169,294 A * 12/1992 Barito ..... 417/310
5,989,000 A * 11/1999 Tomayko et al. ..... 418/55.5
6,077,057 A * 6/2000 Hugenroth et al. ..... 418/55.5
6,341,945 B1 * 1/2002 Hugenroth et al. ..... 418/14

* cited by examiner

*Primary Examiner*—Theresa Trieu
(74) *Attorney, Agent, or Firm*—Carlson, Gaskey & Olds

(57) ABSTRACT

A scroll compressor has a recess cut into a surface of a crankcase or an orbiting scroll while there is no material removed next to the seals that seal refrigerant in the back chamber located between the orbiting scroll and crankcase. Because there is no material removed next to the seals, the gap between the orbiting scroll and crankcase remains intact in the sealing area and the seals continue to operate properly preventing the refrigerant leakage through the gap. In this case, the dimensional tolerances of the crankcase and orbiting scroll surfaces need only be tightly controlled in the area adjacent to the seals. The surface areas away from the seals do not require tight tolerance control, thus manufacturing and assembly is simplified and possibility of interference due to small gap between orbiting scroll and crankcase is avoided. In the preferred embodiment, the recess is introduced into the back chamber surface area of the crankcase.

16 Claims, 2 Drawing Sheets

SCROLL COMPRESSOR WITH RECESS ON CRANKCASE OR ORBITING SCROLL

BACKGROUND OF THE INVENTION

This application relates to a scroll compressor wherein recesses are formed on a crankcase or rear face of an orbiting scroll.

Scroll compressors are widely utilized in refrigerant compression applications. In a scroll compressor, a first scroll member has a base and a generally spiral wrap extending from the base. A second scroll member also has a base and a generally spiral wrap extending from its base. The wraps of the two scroll members interfit to define entrapped fluid chambers. As second scroll member orbits relative to the first scroll member, the volume of the fluid chambers is reduced. The volume chamber reduction causes the compression of entrapped refrigerant.

As the refrigerant is being compressed, pressure in the compression chambers of the two intermeshing scroll wraps produces an axial force acting on the scroll base that tends to separate the two scroll elements away from each other. To resist this separating force, a so-called back pressure chamber is formed between the crankcase forward face and the rear face of the base of the second scroll member. A compressed refrigerant is tapped into this back pressure chamber. Pressure in this back chamber biases the second scroll member back towards the first scroll member. The back pressure chamber is typically defined and sealed by a pair of radially spaced seals. To accommodate for manufacturing and assembly tolerances as well as thermal and structural deformations, the second scroll member is allowed to have a small axial movement with respect to the crankcase.

As can be appreciated, the second scroll member is carefully positioned relative to the crankcase within tight tolerances. If there is too much gap between the rear of the base of the second scroll member and the forward face of the crankcase, the seal reliability can be jeopardized, as the seals need to seal over a wider then desired gap. On the other hand, if the gap is insufficient, then the second scroll member can lock up on the crankcase surface, which will quickly lead to the compressor damage. Thus, a scroll compressor designer has to carefully select the desired gap, taking into account potential production variation in machining the surfaces of the crankcase and orbiting scroll member. As an example, an applicant has found these variations to be on the order of 40 microns across the base of the orbiting scroll or the crankcase facing surface. For this reason, tight tolerances are required in machining the crankcase surface and the rear surface of the second scroll member to maintain the desired gap. However, tighter tolerances call for higher assembly and manufacturing costs.

The present invention is directed to addressing the above-discussed problem.

SUMMARY OF THE INVENTION

In a disclosed embodiment of this invention, recesses are formed into the facing surface of the crankcase, and/or the rear of the face of the orbiting scroll. In particular, if the recesses are formed in the crankcase, it is most desired that at least one recess extend across the back pressure chamber surface area located between the inner and outer seal grooves. The material is preferably not removed on the crankcase surface in an area adjacent to the seal grooves on the unpressurized portion of the back pressure chamber.

Instead, only a small area adjacent the seal grooves, on the unpressurized portion of the back pressure chamber, is left without the recess, and thus tight dimensional tolerances need only be maintained over this smaller surface area. Further, an area not immediately adjacent to the seal groove on the unpressurized portion of the back chamber may also contain a recess on the crankcase surface.

In another distinct embodiment, the recesses are formed into the rear of the orbiting scroll base. In this embodiment the recesses are not formed over the area on the orbiting scroll base that will move over the back pressure chamber seals as the orbiting scroll orbits. It is also possible to combine the features of each of the above-discussed embodiments into a single design configuration.

Either embodiment reduces the crankcase surface area and scroll base plate area that requires tight tolerances, thus simplifying machining and assembly, and alleviating the problem of scrolls lock up or having a larger than desired gap in the area where the orbiting scrolls moves over the back chamber seals. The depth of the recesses is not critical, but is preferably to have a recess with a shallow depth keeping it within a range of 25 to 250 microns if the recess is located within the back chamber. If the depth of the recess exceeds 250 micron it may start having a pronounced effect on the volume of the back chamber, that increase in the volume may not be desirable as it can cause increase the axial movement of the orbiting scroll in axial direction during operation. If the recess is located outside the back chamber, then the depth of the recess can be increased substantially over 250 microns and would normally be limited by structural considerations. The depth can also vary across the recess. The present invention discloses and claims both an apparatus and method for forming the apparatus.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
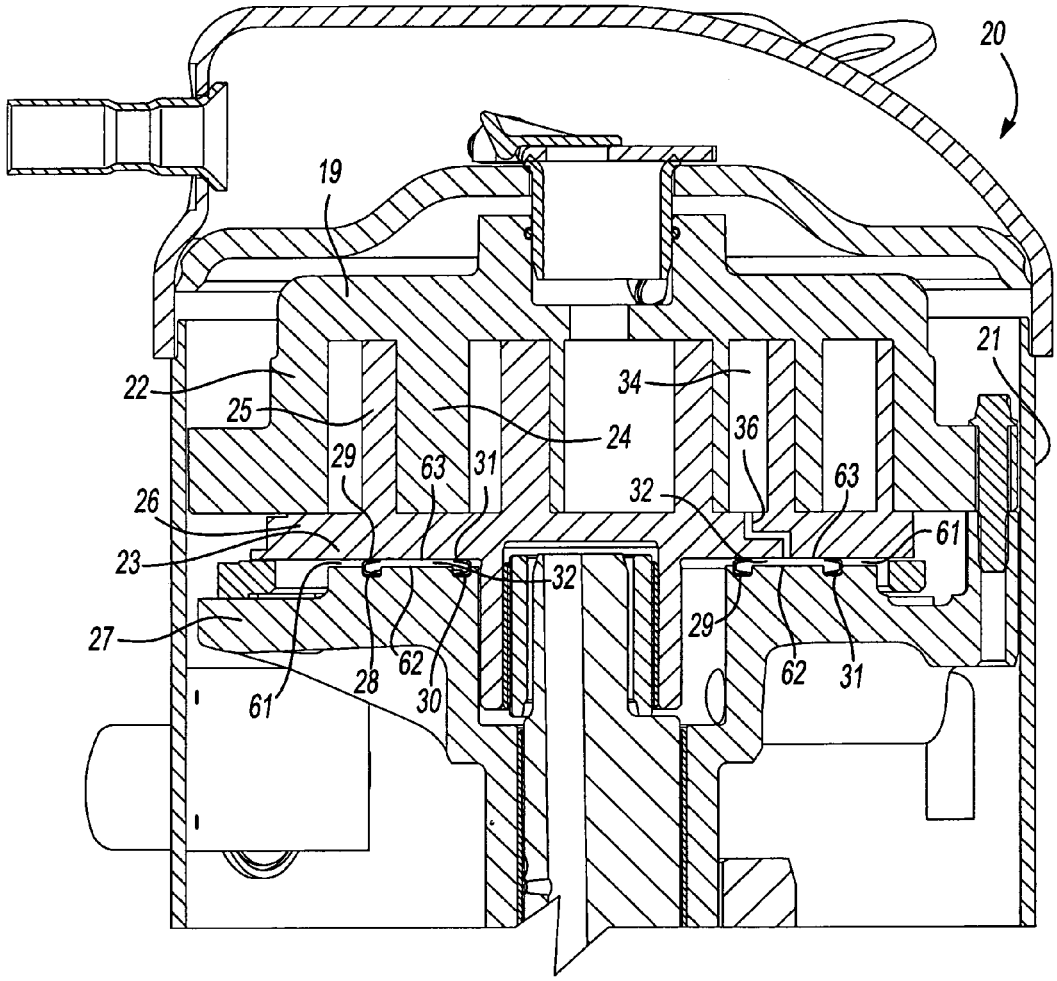
Fig-1 PRIOR ART
FIG. 1 shows a prior art scroll compressor.

FIG. 1 shows a prior art scroll compressor 20 having a shell 21 receiving a non-orbiting scroll 22. The non-orbiting scroll 22 has a base 19 and a generally spiral wrap 24 extending from base 19. An orbiting scroll 26 has a wrap 25 extending from its base 23. As is known, the wraps 24 and 25 interfit to define compression chambers, such as chamber 34.

During operation, there is a gap 61 between back chamber crankcase forward face 62 of the crankcase 27 and a rear face 63 of the orbiting scroll base 23. A back pressure chamber 32 is defined between the forward face 62 of the crankcase and a rear face of 63 of the orbiting scroll base 23 as well as between c-shaped seals 29 and 31. As shown, seal groove 28 receives a c-shaped outer seal 29 and seal groove 30 receives a c-shaped inner seal 31. The back pressure chamber operates as known to bias the orbiting scroll 26 upwardly and toward the non-orbiting scroll 22.

As also known, a tap 36 taps refrigerant from a compression pocket 34 to the back pressure chamber 32 to pressurize refrigerant in the back chamber.

As mentioned above, with the present invention, the manufacturing and assembly processes are simplified because the tolerances in machining the orbiting scroll and crankcase do not need to be as tightly controlled as in the past, also the possibility of scroll lock-ups is greatly diminished, as the clearance between the corresponding orbiting scroll and crankcase surfaces can be made larger over a wider area.

Figure 2:
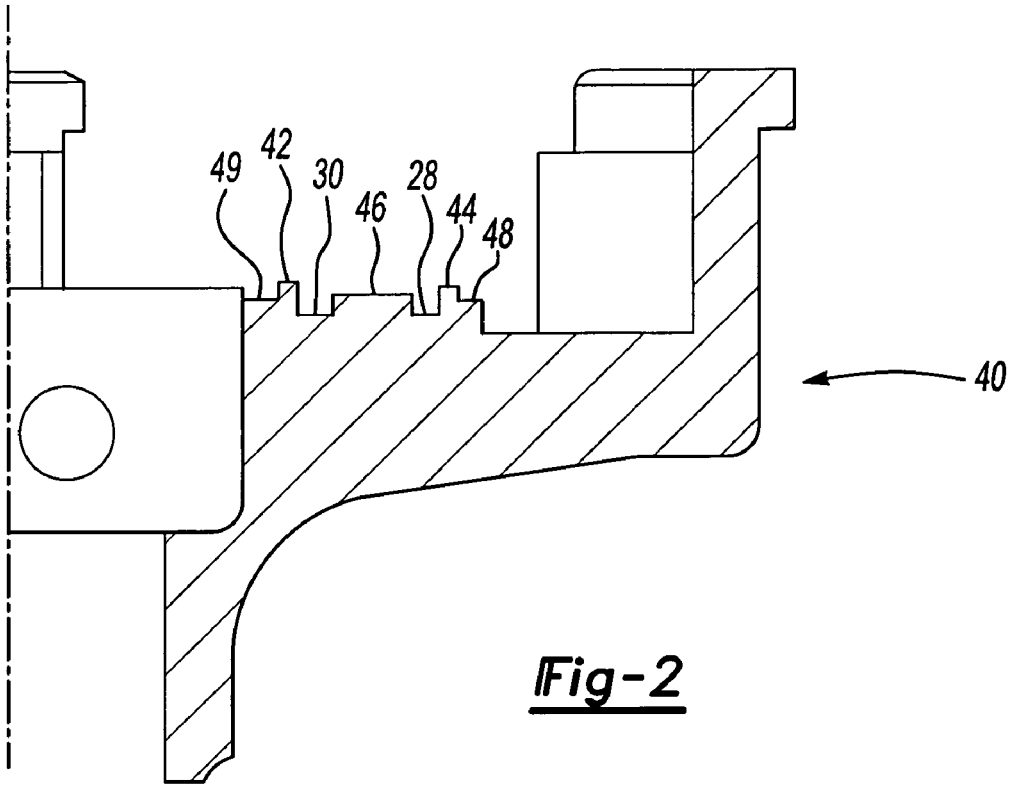
FIG. 2 shows a first embodiment of the present invention.

In an embodiment of a crankcase 40 illustrated in FIG. 2, the forward face of the crankcase includes surfaces 42 and 44 formed adjacent the seal grooves 30 and 28 such that there is a same nominal gap between the rear face of the orbiting scroll surface 63 and surfaces 42 or 44. Recesses 46 and/or recess 48 and/or recess 49 are cut into the face at other areas. In particular, recess 46 is formed on the crankcase surface preferably over the entire width of the raised back pressure chamber area between the seals. As can be appreciated, the seals 29 and 31 need not seal over a wide gap as would otherwise occur if the recess were over the entire surface area of the crankcase 40 (note the surface area 40 includes both the raised area inside the back chamber as well as the area outside of the back chamber area). Instead, the surfaces 42 and 44, that do not have a recessed area, are adjacent to the seals and support the seal as it expands under pressure. Minimization of the gap in the seal area alleviates unwanted extrusion of the seals into the gap. Now, with this invention, the tight tolerances need only be maintained over the small surface areas 42 and 44. The present invention thus addresses the concerns mentioned above.

Figure 3:
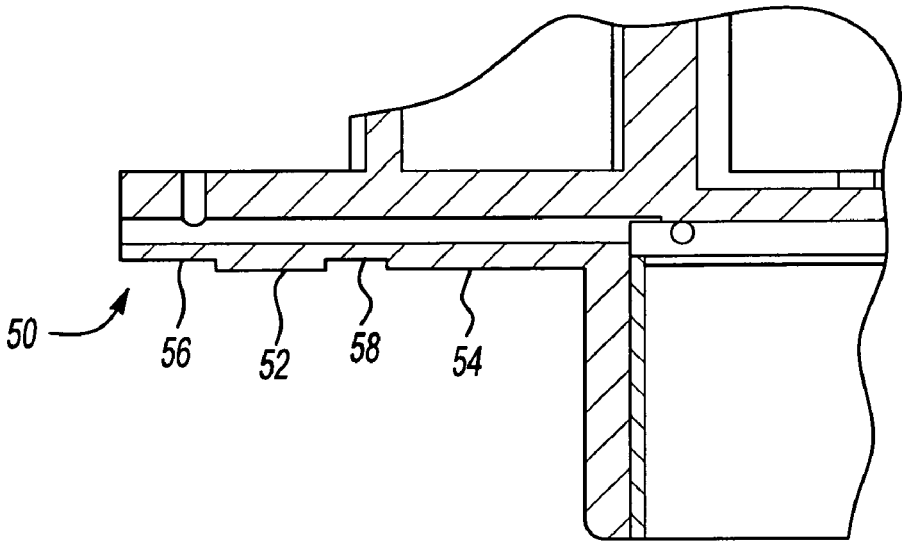
FIG. 3 shows a second embodiment of the present invention.

FIG. 3 shows an alternative embodiment dealing with recesses introduced into the rear face of the orbiting scroll 50. In this embodiment, the nominal surface areas 52 and 54 are left intact, while recesses 56 and 58 are introduced into the rear face of the orbiting scroll base. There is no recess on the surface 52 and 54 where the orbiting scroll 50 moves over the seals 29 and 31. Again, by forming the recesses 56 and 58 away from the seals, the tight tolerances need only be maintained over a much smaller surface area then in the prior art.

Of course, the feature described in each of the above two embodiments can also be combined together to create a third independent embodiment.

Preferred embodiments of this invention have been disclosed. However, a worker of ordinary skill in the art would recognize that certain modifications come within the scope of this invention. For that reason, the following claims should be studied to determine the true scope and content of the present invention.

What is claimed is:

1. A scroll compressor comprising:

a first scroll member having a base and a generally spiral wrap extending from said base;

a second scroll member having a base and a generally spiral wrap extending from said base, said wraps of said first and second scroll members interfitting to define a compression chamber, and said second scroll member being driven to orbit relative to said first scroll member;

a crankcase having a forward surface facing a rear face of said base of said second scroll member;

a back pressure chamber formed between the crankcase and second scroll member, said back pressure chamber sealed by a pair of radially spaced seals, and at least one of said forward surface of said crankcase and said rear face of said base of said second scroll member having at least one recess said at least one recess having a shallow depth between 25 and 250 microns.

2. The scroll compressor as set forth in claim 1, wherein said at least one recess extends only over a portion of a surface area of said at least one of said forward surface or said rear face.

3. The scroll compressor as set forth in claim 2, wherein at least a portion of said remaining area without the said recess is positioned to be adjacent to said seals.

4. The scroll compressor as set forth in claim 1, wherein at least one said recess is formed into said forward surface of said crankcase between said seals.

5. The scroll compressor as set forth in claim 1, wherein at least one recess is formed radially outwardly of a radially outermost one of said seals.

6. The scroll compressor as set forth in claim 1, wherein at least one recess is formed radially inwardly of a radially innermost of one of said seals.

7. The scroll compressor as set forth in claim 1, wherein said at least one recess is formed in said rear face of said second scroll member.

8. The scroll compressor as set forth in claim 7, wherein said rear face area is left intact at areas which will move over said seals during orbital movement of said second scroll member.

9. The scroll compressor as set forth in claim 1, wherein there is at least one recess on said forward surface of said crankcase and there is no recess on said rear face of said orbiting scroll.

10. The scroll compressor as set forth in claim 1, wherein there is no recess on said forward surface of said crankcase and there is at least one recess on said rear face of said orbiting scroll.

11. The scroll compressor as set forth in claim 1, wherein said at least one recess has a variable depth.

12. The scroll compressor as set forth in claim 1, wherein said at least one recess is introduced for the purpose of widening machining and assembly tolerances for said crankcase and said orbiting scroll.

13. The scroll compressor as set forth in claim 1, wherein said at least one recess is introduced for the purpose of improving reliability of said seals.

14. A method of forming a scroll compressor comprising the recesses of:

(1) providing a first and second scroll member, with said first scroll member having a base and a generally spiral wrap extending from said base and said second scroll member also having a base and a generally spiral wrap extending from said base, providing a crankcase having a forward surface facing a rear face of said base of said second scroll member, with said forward surface of said crankcase and said rear face of said base of said second scroll member defining a back pressure chamber formed between the crankcase and second scroll member, said back pressure chamber sealed by a pair of radially spaced seals;

(2) introducing at least one recess into one of said forward surface of said crankcase and said rear face of said base of said second scroll member over a portion of a surface area of said one of said forward surface and said rear face, and said recess being introduced only to a shallow depth between 25 and 250 microns.

15. The method as set forth in claim 14, wherein said recess is introduced into said forward surface of said crankcase.

16. The method as set forth in claim 14, wherein said recess is introduced into said forward surface over an area defined between a pair of seal grooves.

* * * * *